US011692392B2

(12) United States Patent
Qiu

(10) Patent No.: US 11,692,392 B2
(45) Date of Patent: Jul. 4, 2023

(54) ROLLER BLIND BALANCE REGULATOR AND ROLLER BLIND COMPOSED THEREOF

(71) Applicant: Yongzhong Qiu, Guangzhou (CN)

(72) Inventor: Yongzhong Qiu, Guangzhou (CN)

(73) Assignee: Guangzhou JADY Window Coverings Technology CO., LTD., Guangdong (CN)

( * ) Notice: Subject to any disclaimer, the term of this patent is extended or adjusted under 35 U.S.C. 154(b) by 216 days.

(21) Appl. No.: 17/416,414

(22) PCT Filed: Oct. 30, 2020

(86) PCT No.: PCT/CN2020/125368
§ 371 (c)(1),
(2) Date: Jun. 18, 2021

(87) PCT Pub. No.: WO2021/109766
PCT Pub. Date: Jun. 10, 2021

(65) Prior Publication Data

US 2022/0056761 A1 Feb. 24, 2022

(30) Foreign Application Priority Data

Dec. 3, 2019 (CN) ..... 201911220997.0

(51) Int. Cl.
*E06B 9/62* (2006.01)
*E06B 9/42* (2006.01)

(52) U.S. Cl.
CPC . *E06B 9/62* (2013.01); *E06B 9/42* (2013.01)

(58) Field of Classification Search
CPC ..... E06B 9/40; E06B 9/42; E06B 9/62
See application file for complete search history.

(56) References Cited

U.S. PATENT DOCUMENTS

2018/0106107 A1* 4/2018 Smith ..... E06B 9/32
2018/0347269 A1 12/2018 Wang
(Continued)

FOREIGN PATENT DOCUMENTS

CN 107345472 A 11/2017
CN 207122272 U 3/2018
(Continued)

*Primary Examiner* — Beth A Stephan
(74) *Attorney, Agent, or Firm* — Weitzman Law Offices, LLC

(57) ABSTRACT

Disclosed are a roller blind balance regulator and a roller blind composed thereof. The roller blind balance regulator includes a stepped shaft and a friction cylinder, where the stepped shaft is provided with an external thread, the stepped shaft penetrates the friction cylinder, the friction cylinder is provided with an internal thread and is in threaded connection with the stepped shaft, and a friction layer is arranged between the friction cylinder and the stepped shaft. The roller blind includes a roller blind rod, a blind fabric, two mounting members, and the roller blind balance regulator, and a return spring is arranged in the roller blind rod. In the present invention, the roller blind rod drives the friction cylinder to rotate, so that the friction cylinder axially moves along a limiting screw while rotating, thereby increasing or decreasing a friction force between the friction cylinder and the friction layer.

10 Claims, 3 Drawing Sheets

(56) References Cited

U.S. PATENT DOCUMENTS

| | | | | |
|---|---|---|---|---|
| 2019/0264502 | A1* | 8/2019 | Marocco | E06B 9/74 |
| 2020/0355028 | A1* | 11/2020 | Lai | E06B 9/50 |
| 2021/0238922 | A1* | 8/2021 | Schorling | F16D 59/00 |

FOREIGN PATENT DOCUMENTS

| | | | | |
|---|---|---|---|---|
| CN | 208267736 | U | | 12/2018 |
| CN | 110984826 | A | | 4/2020 |
| CN | 211647936 | U | | 10/2020 |
| CN | 215804287 | U | * | 2/2022 |
| JP | S5785482 | A | | 5/1982 |
| JP | 2009097171 | A | | 5/2009 |

* cited by examiner

ROLLER BLIND BALANCE REGULATOR AND ROLLER BLIND COMPOSED THEREOF

TECHNICAL FIELD

The present invention relates to a roller blind balance regulator and a roller blind composed thereof, belonging to the technical field of household articles.

BACKGROUND

Pull bead roller blinds are more and more used by people, but children are often subjected to some safety hazards due to pull beads. In some places, it is difficult to mount and inconvenient to operate the pull bead roller blind. However, it is impossible to increase costs to mount an electric roller blind, and even no power supply is available in some places. In order to solve these problems, the demand for hand-propelled roller blind systems is increasing. The hand-propelled roller blind system is implemented under the condition of pretightening force of a spring. During use, as a blind body rises or falls, the elastic force of the spring on a roller blind rod is different. In long-term use, when a transmission force of each component changes, it is very difficult to balance the torque, which will seriously affect the use of the roller blind. Therefore, spring systems must be specially designed for the current roller blind systems on the market according to different widths, heights, and even different fabrics. This will result in a large number of specifications, an increase in inventory, and inconvenience in production.

SUMMARY

An object of the present invention is to address at least one of technical problems in the prior art, and provide a roller blind balance regulator and a roller blind composed thereof, which can dynamically balance torque generated by a return spring.

According to an embodiment in a first aspect of the present invention, a roller blind balance regulator is provided, including: a stepped shaft, where a side of a small-diameter section of the stepped shaft is provided with an external thread; and a friction cylinder connected to a roller blind rod, where the stepped shaft penetrates the friction cylinder, the friction cylinder is internally provided with an internal thread, an inner side of the friction cylinder is in threaded connection with the small-diameter section of the stepped shaft, and a friction layer is arranged between the friction cylinder and a large-diameter section of the stepped shaft.

According to an embodiment in the first aspect of the present invention, further, the stepped shaft includes a limiting screw and a mandrel, the mandrel is provided with a mandrel through hole in an axial direction, and the limiting screw penetrates and is fixed in the mandrel through hole.

According to an embodiment in the first aspect of the present invention, further, the inner side of the friction cylinder is provided with a stepped portion, the mandrel is located in the large-diameter section in the friction cylinder, the internal thread is arranged on the small-diameter section in the friction cylinder, an end face of a first end of the mandrel is provided with a first ratchet, and a shoulder of the stepped portion of the friction cylinder is provided with a second ratchet capable of meshing with the first ratchet.

According to an embodiment in the first aspect of the present invention, further, an end face of the friction cylinder is provided with a third ratchet, and the limiting screw is provided with a fourth ratchet capable of meshing with the third ratchet.

According to an embodiment in the first aspect of the present invention, further, an outer side of a second end of the mandrel is provided with an annular protrusion, the annular protrusion is provided with at least one countersunk screw hole, a hole axis of the countersunk screw hole is perpendicular to the limiting screw, and a bolt is inserted into the countersunk screw hole and then abuts against the limiting screw.

According to an embodiment in the first aspect of the present invention, a roller blind is provided, including a roller blind rod, a blind fabric, two mounting members, and a roller blind balance regulator, where the blind fabric is wound around the roller blind rod, two ends of the roller blind rod are mounted on the mounting members, a return spring is arranged in the roller blind rod, a friction cylinder is connected to the roller blind rod, and one end of a stepped shaft is fixed on one of the mounting members.

According to an embodiment in a second aspect of the present invention, a roller blind balance regulator is provided, including a fixing part and a friction cylinder connected to a roller blind rod, where the fixing part includes a sleeve and a center rod fixed in the sleeve, the center rod is arranged in an axial direction of the sleeve, and a space allowing the friction cylinder to be inserted is formed between the sleeve and the center rod; the friction cylinder is inserted in the space between the sleeve and the center rod, the center rod penetrates the friction cylinder, the friction cylinder has an inner side surface and an outer side surface, one of the side surfaces of the friction cylinder is in threaded connection with the fixing part, and a friction layer is arranged between the other side surface of the friction cylinder and the fixing part.

According to an embodiment in the second aspect of the present invention, further, the center rod is provided with an external thread, the inner side surface of the friction cylinder is provided with an internal thread, the friction cylinder is in threaded connection with the center rod, and the friction layer is located between the outer side surface of the friction cylinder and the sleeve.

According to an embodiment in the second aspect of the present invention, further, an inner side of the sleeve is provided with an internal thread, the outer side surface of the friction cylinder is provided with an external thread, the friction cylinder is in threaded connection with the sleeve, and the friction layer is located between the inner side surface of the friction cylinder and the center rod.

According to an embodiment in a third aspect of the present invention, a roller blind is provided, including a roller blind rod, a blind fabric, two mounting members, and a roller blind balance regulator, where the blind fabric is wound around the roller blind rod, two ends of the roller blind rod are mounted on the mounting members, a return spring is arranged in the roller blind rod, a friction cylinder is connected to the roller blind rod, and one end of a fixing part is fixed on one of the mounting members.

In the present invention, the torque of the return spring can be better balanced, and the friction force between the friction cylinder and the friction layer can dynamically compensate for a torque difference of the return spring, thereby having a good use effect. The present invention has the following beneficial effects:

I. The roller blind rod drives the friction cylinder to rotate, and the friction cylinder axially moves along a limiting screw while rotating, thereby increasing or decreasing a friction force between the friction cylinder and the friction layer. When the roller blind rod rotates, the friction cylinder can increase or decrease the friction force between the friction cylinder and the friction layer as the torque of the return spring changes, thereby achieving the function of dynamically balancing the return spring.

II. The roller blind rod drives the friction cylinder to rotate, so that the friction cylinder moves in an axial direction of a fixing part while rotating, thereby increasing or decreasing a friction force between the friction cylinder and the friction layer. When the roller blind rod rotates, the friction cylinder can increase or decrease the friction force between the friction cylinder and the friction layer as the torque of the return spring changes, thereby achieving the function of dynamically balancing the return spring.

BRIEF DESCRIPTION OF THE DRAWINGS

In order to more clearly illustrate the technical solutions in the embodiments of the present invention, the accompanying drawings used in the description of the embodiments are briefly described below. Apparently, the described accompanying drawings only illustrate some embodiments of the present invention, and not all of the embodiments, and those skilled in the art can obtain other design solutions and accompanying drawings according to these accompanying drawings without any creative work.

DETAILED DESCRIPTION

Figure 1:
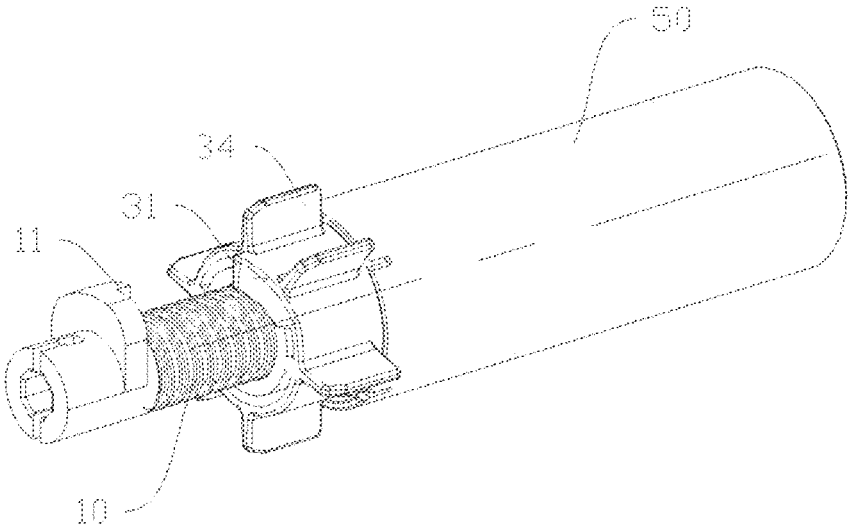
FIG. 1 is a schematic structural diagram of a roller blind balance regulator according to Embodiment one of the present invention.
Figure 2:
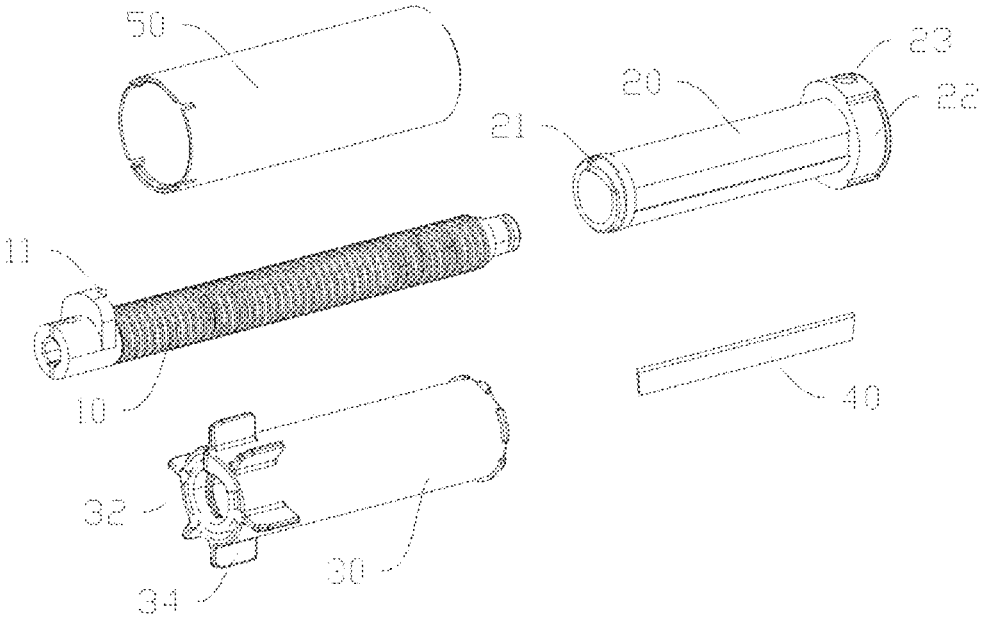
FIG. 2 is an exploded view of the roller blind balance regulator according to Embodiment one of the present invention.
Figure 3:
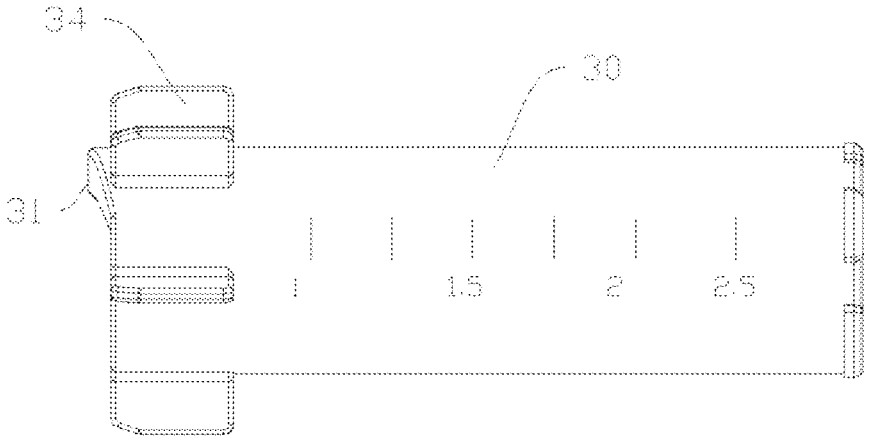
FIG. 3 is a front view of a friction cylinder according to Embodiment one of the present invention.
Figure 4:
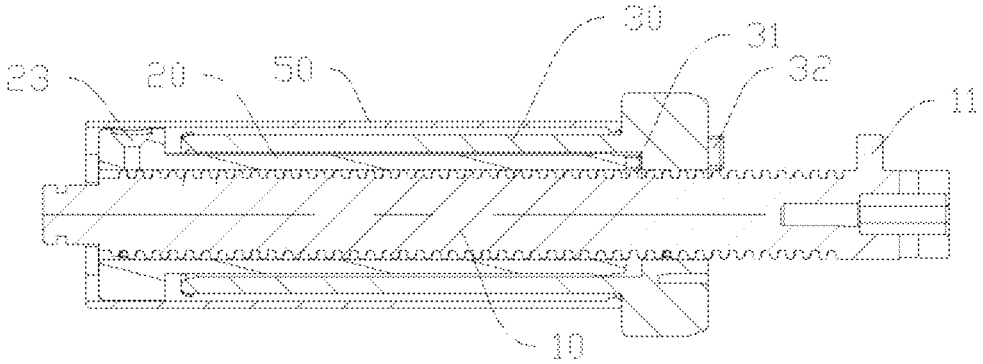
FIG. 4 is a front cross-sectional view of the roller blind balance regulator according to Embodiment one of the present invention.

This section describes the specific embodiments of the present invention in detail, and the preferred embodiments of the present invention are shown in the accompanying drawings. The function of the accompanying drawings is to supplement the description of the text part of the specification with graphics, so that people can visually and vividly understand each technical feature and the overall technical solution of the present invention, but the accompanying drawings cannot be understood as limiting the protection scope of the present invention.

In the description of the present invention, it should be understood that if orientation description is involved, the orientation or position relationship indicated by, for example, "up", "down", "front", "rear", "left" and "right" is based on the orientation or position relationship shown in the drawings, and these terms are just used to facilitate description of the present invention and simplify the description, but not to indicate or imply that the mentioned apparatus or elements must have a specific orientation and must be established and operated in a specific orientation, and thus, these terms cannot be understood as a limitation to the present invention.

In the description of the present invention, "several" means one or more, and "a plurality of" means more than two. "Greater than", "less than", "exceeding", and the like are understood as excluding this number, and "above", "below", "within", and the like are understood as including this number. "First" and "second" in the description are only for the purpose of distinguishing between technical features, and cannot be understood as indicating or implying relative importance or implicitly indicating the number of technical features indicated or implicitly indicating the sequence relationship of indicated technical features.

In the description of the present invention, unless otherwise explicitly defined, the words such as "setting", "mounting" and "connection" should be understood in a broad sense, and those skilled in art can properly determine the specific meanings of the above words in the present invention with reference to the specific contents of the technical solution.

Embodiment One

Referring to FIGS. 1 to 4, a roller blind balance regulator in this embodiment includes a limiting screw 10, a mandrel 20, and a friction cylinder 30. The mandrel 20 is provided with a mandrel through hole in an axial direction, and the limiting screw 10 penetrates and is fixed in the mandrel through hole. An outer side of a second end of the mandrel 20 is provided with an annular protrusion 22, the annular protrusion 22 is provided with at least one countersunk screw hole 23, and a hole axis of the countersunk screw hole 23 is perpendicular to the limiting screw 10. The annular protrusion 22 may be integrally formed with the mandrel 20. A bolt is screwed into the countersunk screw hole 23, and a bottom end of the bolt abuts against the limiting screw 10, thereby fixing the relative positions of the mandrel 20 and the limiting screw 10. The mandrel 20 is inserted in the friction cylinder 30. Preferably, the inner side of the friction cylinder 30 is provided with a stepped portion, the mandrel 20 is located in a large-diameter section in the friction cylinder 30, a small-diameter section of the friction cylinder 30 is provided with an internal thread, and the friction cylinder 30 is in threaded connection with the limiting screw 10. A friction layer is arranged between the mandrel 20 and the large-diameter section of the friction cylinder 30. The friction layer includes at least one friction plate 40. For different return springs, roller blind rods and blind fabrics in the roller blind, the friction plates can be appropriately increased or decreased to ensure that the torque of the return spring can be effectively balanced.

Further, in a preferred implementation, the friction plates 40 may be long friction plates, there are three or more friction plates, the friction plates 40 are circumferentially distributed outside the mandrel 20, and the friction plates 40 are equally spaced. In an equivalent implementation, the friction plate 40 may also be a cylindrical friction plate, and the cylindrical friction plate is sleeved outside the mandrel 20. In addition, the friction layer may be directly integrally formed with the outer side surface of the mandrel 20.

Further, in a preferred implementation, an end face of a first end of the mandrel 20 is provided with a first ratchet 21, and a shoulder of the stepped portion of the friction cylinder 30 is provided with a second ratchet 31 capable of meshing with the first ratchet 21. When the blind fabric is completely lowered, the first ratchet 21 on the mandrel 20 meshes with the second ratchet 31 of the friction cylinder 30, so as to prevent the blind fabric from continuing to descend or even break away from the roller blind rod. Correspondingly, an end face of the friction cylinder 30 is provided with a third ratchet 32, and the limiting screw 10 is provided with a fourth ratchet 11 capable of meshing with the third ratchet 32. When the blind fabric is completely wound, the friction cylinder 30 moves to make the third ratchet 32 mesh with the fourth ratchet on the limiting screw 10, thereby restricting the roller blind rod 30 from continuing to rotate.

Further, in a preferred implementation, the outer side surface of the friction cylinder 30 is provided with a length scale in an axial direction. The friction cylinder 30 is provided with an outer cover 50, and the outer cover 50 is sleeved outside the mandrel 20 and the friction cylinder 30. The outer cover 50 is fixed on the annular protrusion 22 of the mandrel 20. The outer cover 50 is aligned with the length scale on the friction cylinder 30 to determine a relative friction force between the friction cylinder 30 and the mandrel 20 at this position, so as to better make adjustments according to different roller blind rods and blind fabrics before use.

Further, in a preferred implementation, at least two convex ribs 34 are arranged outside the friction cylinder 30, and the convex ribs 34 are arranged in a length direction of the friction cylinder 30. When rotating, the roller blind rod is linked with the friction cylinder 30 through the convex ribs 34, thereby driving the friction cylinder 30 to rotate.

Further, in a preferred implementation, the inner side of the mandrel 20 is provided with at least one oil groove. The oil groove may be an annular groove, and the annular oil groove is circumferentially arranged inside the mandrel 20. Preferably, a plurality of annular oil grooves are arranged at intervals in the axial direction of the mandrel 20. In an equivalent alternative implementation, the oil groove may be a straight groove, and preferably, a plurality of straight grooves are arranged in the axial direction of the mandrel 20. Lubricating oil is injected into the oil groove so that lubricating oil is present between the mandrel 20 and the limiting screw 10, thereby reducing the noise generated by the collision of the mandrel 20 and the limiting screw.

The operating principle of the roller blind balance regulator is as follows: When rotating, the roller blind rod drives the friction cylinder 30 to rotate, and the friction cylinder 30 moves along the limiting screw 10, so that the contact area between the friction cylinder 30 and the friction plate 40 on the mandrel 20 changes, and thus the friction force between the friction cylinder 30 and the mandrel 20 changes to dynamically adapt to the torque of the roller blind spring.

The roller blind in this embodiment includes a roller blind rod, a blind fabric, two mounting members, and a roller blind balance regulator, where the blind fabric is wound around the roller blind rod, two ends of the roller blind rod are mounted on the mounting members, a return spring is arranged in the roller blind rod, one end of the return spring is connected to the roller blind rod, and the other end of the return spring is connected to one of the mounting members. The friction cylinder 30 is connected to the roller blind rod, and one end of the limiting screw 10 or the stepped shaft is fixed on one of the mounting members.

The operating principle of the roller blind is as follows: After the roller blind rod, the blind fabric and the roller blind balance regulator are mounted, the return spring is pretightened, and the roller blind rod is mounted between the two mounting members. The torque of the return spring is equal to the sum of a gravitational force of the blind fabric and a lower rail and a friction force between the friction cylinder 30 and the friction plate 40. While the blind fabric is pulled down, the roller blind rod rotates and drives the friction cylinder 30, and the friction cylinder 30 moves axially along the limiting screw 10 while rotating; and the contact area between the friction cylinder 30 and the friction plate on the mandrel 20 increases, i.e., the friction force between the friction cylinder 30 and the friction plate 40 increases. When the blind fabric descends, the gravitational force of a hanging part of the blind fabric increases, and the torque of the return spring increases. In order to balance the torque of the return spring, the friction force between the friction cylinder 20 and the friction plate 40 increases to resist the movement trend of the roller blind rod, so that the blind fabric can stop in the position expected by a user. When the blind fabric descends to a lower limit, the first ratchet 21 meshes with the second ratchet 31 to prevent the roller blind rod from continuing to rotate and prevent the blind fabric from falling off from the roller blind rod. In the same way, when the blind fabric rises, the torque of the return spring is reduced, and the friction force between the friction cylinder 30 and the mandrel 20 is also reduced. When the blind fabric reaches an upper limit, the third ratchet 32 meshes with the fourth ratchet 11, and the roller blind rod no longer rotates. During the use of the roller blind, as the roller blind rod rotates, the friction force between the friction cylinder 30 and the friction plate 40 can always dynamically compensate for the torque generated by the winding or unwinding of the blind fabric and the torque difference of the return spring, thereby achieving very good balance effects.

Embodiment Two

Figure 5:
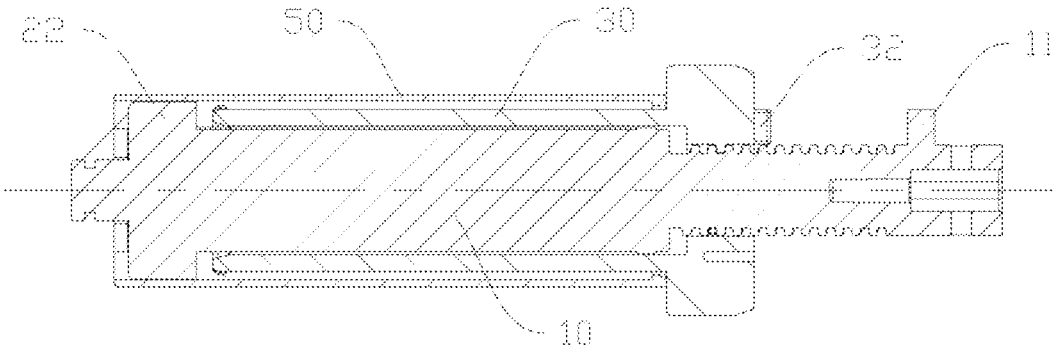
FIG. 5 is a front cross-sectional view of a roller blind balance regulator according to Embodiment two of the present invention.

Referring to FIG. 5, a roller blind balance regulator in this embodiment differs from Embodiment one only in that the mandrel 20 and the limiting screw 10 jointly form an integrally-formed stepped shaft. A small-diameter section of the stepped shaft is provided with a thread, the friction cylinder 30 is in threaded connection with the small-diameter section of the stepped shaft, and a friction layer is arranged between the friction cylinder 30 and a large-diameter section of the stepped shaft. This arrangement can prevent the wear caused by the collision between the mandrel 20 and the limiting screw 10 and simplify the structure.

Embodiment Three

Figure 6:
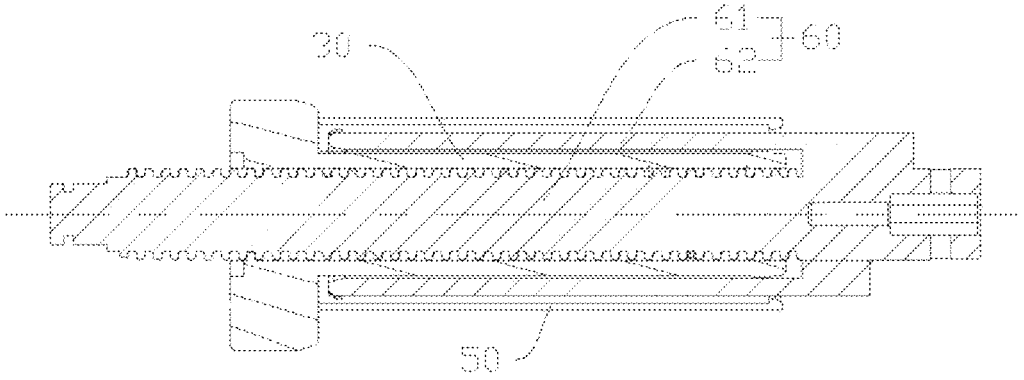
FIG. 6 is a front cross-sectional view of a roller blind balance regulator according to Embodiment three of the present invention.

Referring to FIG. 6, a roller blind balance regulator in this embodiment includes a fixing part 60 and a friction cylinder 30 connected to a roller blind rod. The fixing part 60 includes a sleeve 62 and a center rod 61 fixed in the sleeve 62, the center rod 61 is arranged in an axial direction of the sleeve 62, and a space allowing a friction cylinder 30 to be inserted is formed between the sleeve 62 and the center rod 61. Optionally, the center rod 61 may be integrally formed with the sleeve 62. The friction cylinder 30 has an inner side surface and an outer side surface, one of the side surfaces of the friction cylinder 30 is in threaded connection with the fixing part 60, and a friction layer is arranged between the other side surface of the friction cylinder 30 and the fixing part 60. The friction cylinder 30 is inserted in the space between the sleeve 62 and the center rod 61, and the center rod 61 penetrates the friction cylinder 30. Optionally, the center rod 61 is provided with an external thread, the inner side surface of the friction cylinder 30 is provided with an internal thread, and the friction cylinder 30 is in threaded connection with the center rod 61; the friction cylinder 30 can move along the center rod 61, and the friction layer is located between the outer side surface of the friction cylinder 30 and the sleeve 62. The friction layer includes at least one friction plate 40. For different return springs, roller blind rods and blind fabrics of different weights in the roller blind, the friction plates can be appropriately increased or decreased to ensure that the torque of the return spring can be effectively balanced.

Further, in a preferred implementation, the friction plates 40 may be long friction plates, there are three or more friction plates, the friction plates 40 are circumferentially distributed outside the mandrel 20, and the friction plates 40 are equally spaced. In an equivalent implementation, the friction plate 40 may also be a cylindrical friction plate, and the cylindrical friction plate is sleeved outside the friction cylinder 30. In addition, the friction layer may be directly integrally formed with the outer side surface of the friction cylinder 30, or, the friction layer may be integrally formed with the inner side surface of the sleeve 62.

Further, in a preferred implementation, at least two convex ribs 34 are arranged outside the friction cylinder 30, and the convex ribs 34 are arranged in a length direction of the friction cylinder 30. When rotating, the roller blind rod is linked with the friction cylinder 30 through the convex ribs 34, thereby driving the friction cylinder 30 to rotate.

Further, in a preferred implementation, the outer side surface of the friction cylinder 30 is provided with a length scale in an axial direction. The sleeve 62 is provided with an outer cover 50, and the outer cover 50 is sleeved outside the sleeve 62. The outer side surface of the friction cylinder 30 is provided with a length scale in an axial direction. The outer cover 50 is aligned with the length scale on the friction cylinder 30 to determine a relative friction force between the friction cylinder 30 and the sleeve 62 at this position, so as to better make adjustments according to different roller blind rods and blind fabrics before use.

Further, in a preferred implementation, the inner side of the friction cylinder 30 is provided with at least one oil groove. The oil groove may be an annular groove, and the annular oil groove is circumferentially arranged inside the friction cylinder 30. Preferably, a plurality of annular oil grooves are arranged at intervals in the axial direction of the friction cylinder 30. In an equivalent alternative implementation, the oil groove may be a straight groove, and preferably, a plurality of straight grooves are arranged in the axial direction of the friction cylinder 30. Lubricating oil is injected into the oil groove so that lubricating oil is present between the friction cylinder 30 and the center rod 61, thereby reducing the noise generated by the collision of the friction cylinder 30 and the center rod 61.

The operating principle of the roller blind balance regulator is as follows: When rotating, the roller blind rod drives the friction cylinder 30 to rotate, and the friction cylinder 30 moves along the center rod 61, so that the contact area between the friction cylinder 30 and the friction plate 40 on the inner side of the sleeve 62 changes, and thus the friction force between the friction cylinder 30 and the friction plate 40 changes to dynamically adapt to the torque of the roller blind spring.

In an equivalent alternative to the above implementation, optionally, the outer side surface of the friction cylinder 30 is in threaded connection with the sleeve 62, an inner side of the sleeve 62 is provided with an internal thread, the outer side surface of the friction cylinder 30 is provided with an external thread, the friction cylinder 30 is in threaded connection with the sleeve 62, and the friction layer is located between the inner side surface of the friction cylinder 30 and the center rod 61. Preferably, the friction plate 40 is fixed on the center rod 61. The rest of the structure is the same as described above.

The roller blind in this embodiment includes a roller blind rod, a blind fabric, two mounting members, and a roller blind balance regulator, where the blind fabric is wound around the roller blind rod, two ends of the roller blind rod are mounted on the mounting members, a return spring is arranged in the roller blind rod, the friction cylinder 30 is connected to the roller blind rod, and one end of the fixing part 60 is fixed on one of the mounting members.

The operating principle of the roller blind is as follows: After the roller blind rod, the blind fabric and the roller blind balance regulator are mounted, the return spring is pretightened, and the roller blind rod is mounted between the two mounting members. The torque of the return spring is equal to the sum of a gravitational force of the blind fabric and a lower rail and a friction force between the friction cylinder 30 and the friction plate 40. While the blind fabric is pulled down, the roller blind rod rotates and drives the friction cylinder 30, and the friction cylinder 30 moves axially along the center rod 61 while rotating; and the contact area between the friction cylinder 30 and the friction plate 40 on the inner side of the sleeve 62 increases, i.e., the friction force between the friction cylinder 30 and the friction plate 40 increases. When the blind fabric descends, the gravitational force of a hanging part of the blind fabric increases, and the torque of the return spring increases. In order to balance the torque of the return spring, the friction force between the friction cylinder 20 and the friction plate 40 increases to resist the movement trend of the roller blind rod, so that the blind fabric can stop in the position expected by a user. When the blind fabric rises, the torque of the return spring is reduced, and the friction force between the friction cylinder 30 and the mandrel 20 is also reduced. When the blind fabric reaches the upper limit, the friction cylinder 30 moves to abut against the mounting yard connected to the fixing part, and the roller blind rod no longer rotates. During the use of the roller blind, as the roller blind rod rotates, the friction force between the friction cylinder 30 and the friction plate 40 can always dynamically compensate for the torque generated by the winding or unwinding of the blind fabric and the torque difference of the return spring, thereby achieving very good balance effects.

The preferred embodiments of the present invention have been described in detail above, but the present invention is not limited to the embodiments, and various equivalent modifications or replacements can be made by those skilled in the art without departing from the spirit of the present invention. These equivalent modifications or replacements fall within the scope of the claims of the present application.

What is claimed is:

1. A roller blind balance regulator, comprising:

a stepped shaft, wherein an external thread is provided at a side of a small-diameter section of the stepped shaft; and a friction cylinder connected to a roller blind rod, wherein the stepped shaft is configured to penetrate the friction cylinder, the friction cylinder is internally provided with an internal thread, an inner side of the friction cylinder is in threaded connection with the small-diameter section of the stepped shaft, and a friction layer is arranged between the friction cylinder and a large-diameter section of the stepped shaft.

2. The roller blind balance regulator of claim 1, wherein the stepped shaft comprises a limiting screw and a mandrel, the mandrel is provided with a mandrel through hole in an axial direction, and the limiting screw is configured to penetrate and is fixed in the mandrel through hole.

3. The roller blind balance regulator of claim 2, wherein the inner side of the friction cylinder is provided with a stepped portion, the mandrel is located in the large-diameter section in the friction cylinder, the internal thread is arranged on the small-diameter section in the friction cylinder, an end face of a first end of the mandrel is provided with a first ratchet, and a shoulder of the stepped portion of the friction cylinder is provided with a second ratchet capable of meshing with the first ratchet.

4. The roller blind balance regulator of claim 2, wherein an end face of the friction cylinder is provided with a third ratchet, and the limiting screw is provided with a fourth ratchet capable of meshing with the third ratchet.

5. The roller blind balance regulator of claim 2, wherein an outer side of a second end of the mandrel is provided with an annular protrusion, the annular protrusion is provided with at least one countersunk screw hole, a hole axis of the countersunk screw hole is perpendicular to the limiting screw, and a bolt is inserted into the countersunk screw hole and then abuts against the limiting screw.

6. A roller blind, comprising a roller blind rod, a blind fabric, two mounting members, and the roller blind balance regulator of claim 1, wherein the blind fabric is wound around the roller blind rod, two ends of the roller blind rod are mounted on the mounting members, a return spring is arranged in the roller blind rod, the friction cylinder is connected to the roller blind rod, and one end of the stepped shaft is fixed on one of the mounting members.

7. A roller blind balance regulator, comprising:

a fixing part, wherein the fixing part comprises a sleeve and a center rod fixed in the sleeve, the center rod is arranged in an axial direction of the sleeve, and a space allowing a friction cylinder to be inserted is formed between the sleeve and the center rod; and the friction cylinder connected to a roller blind rod, wherein the friction cylinder is inserted in the space between the sleeve and the center rod, the center rod penetrates the friction cylinder, the friction cylinder has an inner side surface and an outer side surface, one of the side surfaces of the friction cylinder is in threaded connection with the fixing part, and a friction layer is arranged between the other side surface of the friction cylinder and the fixing part.

8. The roller blind balance regulator of claim 7, wherein the center rod is provided with an external thread, the inner side surface of the friction cylinder is provided with an internal thread, the friction cylinder is in threaded connection with the center rod, and the friction layer is located between the outer side surface of the friction cylinder and the sleeve.

9. The roller blind balance regulator of claim 7, wherein an inner side of the sleeve is provided with an internal thread, the outer side surface of the friction cylinder is provided with an external thread, the friction cylinder is in threaded connection with the sleeve, and the friction layer is located between the inner side surface of the friction cylinder and the center rod.

10. A roller blind, comprising a roller blind rod, a blind fabric, two mounting members, and the roller blind balance regulator of claim 7, wherein the blind fabric is wound around the roller blind rod, two ends of the roller blind rod are mounted on the mounting members, a return spring is arranged in the roller blind rod, the friction cylinder is connected to the roller blind rod, and one end of the fixing part is fixed on one of the mounting members.

* * * * *